US006057023A

United States Patent [19]

Shimono et al.

[11] Patent Number: 6,057,023

[45] **Date of Patent: *May 2, 2000**

[54] MAT

[75] Inventors: Kikuo Shimono; Yuji Nagahama, both of Suita, Japan

[73] Assignee: Duskin Co., Ltd., Osaka, Japan

[ * ] Notice: This patent is subject to a terminal disclaimer.

[21] Appl. No.: 09/019,038

[22] Filed: Feb. 5, 1998

[30] Foreign Application Priority Data

Feb. 14, 1997 [JP] Japan ..... 9-030146
Jan. 20, 1998 [JP] Japan ..... 10-008454

[51] Int. Cl.[7] ..... A47G 27/02
[52] U.S. Cl. ..... 428/92; 428/97
[58] Field of Search ..... 428/85, 92, 97; 57/236

[56] References Cited

U.S. PATENT DOCUMENTS 5,198,278 3/1993 Sumimoto ..... 428/95
5,305,565 4/1994 Nagahama et al. ..... 428/95
5,524,317 6/1996 Nagahama et al. ..... 15/217
5,680,826 10/1997 Nagahama et al. ..... 112/410
5,725,705 3/1998 Nagahama et al. ..... 156/148
5,887,416 3/1999 Shimono et al. ..... 57/236

*Primary Examiner*—Newton Edwards
*Attorney, Agent, or Firm*—Evenson, McKeown, Edwards & Lenahan, PLLC

[57] ABSTRACT

A mat, in which a pile yarn is tufted onto a base cloth and the entire or a part of pile shape is a cut pile. A part of or the entire pile yarn on a mat surface comprises a twist yarn formed by twisting two or more temporary twist yarns together. Each temporary twist yarn is formed by twisting a paralleled yarn comprising a great number of single yarns of one-kind fiber selected voluntarily from BCF nylon, vinylon, rayon, acryl, polyester and cotton; and one or more nylon monofilament single yarns. A number of kind of paralleled yarn fiber is one or two or larger in the entire temporary twist yarn of the twist yarn. In this mat, merits of both: conventional outdoor and indoor mats, can be provided and demerits of them can be compensated.

3 Claims, 3 Drawing Sheets

MAT

BACKGROUND ART

This invention relates to a mat, in which a pile yarn is tufted onto a base cloth and the entire or a part of pile shape is a cut pile. This mat is mainly used for a rental purpose.

A conventional mat, in which a pile yarn is tufted onto a base cloth and the entire or a part of pile shape is a cut pile, is roughly classified into two categories: outdoor type and indoor type. The outdoor mat is required to provide a brushing force in order to remove a great quantity of dust including comparatively large grain size, or to remove dust efficiently from corrugated shoe soles. Therefore, the pile yarn of the outdoor mat is composed of a nylon monofilament twist yarn comprising a thick nylon monofilament single yarn. An artificial grass is a typical example of it. Since the indoor mat is required to provide a high holding ability of moisture and dust, its pile yarn is composed of a twist yarn comprising thin single yarn of fibers such as BCF nylon, vinylon, rayon, acryl, polyester, cotton etc.

FIG. 7 is a vertical sectional partial view of a conventional indoor mat. A pile yarn 10 comprises a BCF nylon twist yarn. The pile yarn 10 is secured to a rubber sheet 3 in such a manner that it is tufted onto a base cloth 2 and fixed by a bonding agent such as a latex 4 on a non-piled surface as occasion demands. This is called as an integral type. The entire or a part of the pile yarn 10 has a shape of cut-pile. FIG. 7 shows the cut-pile only. FIG. 8 is a schematic view showing a state of the pile yarn 10 of FIG. 7. The pile yarn 10 opens to an U-shape.

Generally, the BCF nylon twist yarn is formed by twisting two to four paralleled yarns comprising sixty-eight BCF nylon single yarns. A size of one BCF nylon single yarn frequently used is about 20 deniers. On the other hand, the nylon monofilament twist yarn is formed by twisting about several to ten nylon monofilament single yarns, and a size of one nylon monofilament single yarn is about 200 to 500 deniers. Generally, a size of the BCF nylon single yarn is 5 to 80 deniers and that of the nylon monofilament single yarn is 100 to 1,000 deniers. A size of single yarn fiber of vinylon, rayon, acryl, polyester, cotton etc., is 1 to 10 deniers.

The outdoor mat and indoor mat have included the following merits and demerits respectively. The outdoor mat has provided a large brushing force to produce a large dust removing effect, because each nylon monofilament twist yarn has been stiff and standing upright. However, variation of color pattern of produced colored pile yarn has been limited to a small range and a touch of fabric has not been changed, so that the mat has been unable to meet demands of customer. Since a specific surface area of one nylon monofilament twist yarn has been small due to thickness of one nylon monofilament single yarn, it has been inevitable to increase a weight of pile yarn used per unit area in order to give clear color pattern to the mat, so that its cost has been increased.

On the other hand, the indoor mat has provided an excellent holding ability of moisture and dust and realized a variety of color owing to the BCF nylon twist yarn differing from the nylon monofilament twist yarn, so that it has been able to meet demands of customer satisfactorily. However, the BCF nylon twist yarn has been soft and its revealed cut section of twist yarn has been released from the twisted state, so that tip end of the cut section has been separated and opened. Therefore, it has been difficult to enhance the brushing ability and the dust removing effect has been small. In the indoor mat as illustrated in FIG. 9, two paralleled yarns 101 composing the pile yarn 10 are separated and opened from the cut end face so that the pile yarn 10 becomes unable to provide the dust removal function required for the dust control mat.

For this reason, it has become required to produce a mat which can compensate demerits of both the outdoor and indoor mats and make use of their merits, and further to produce a mat suitable for use in an intermediate purpose for both indoor and outdoor purposes. An object of this invention is to provide such a mat.

SUMMARY OF THE INVENTION

In order to accomplish the above object, a first invention of this application, in which a pile yarn is tufted onto a base cloth and the entire or a part of pile yarn has a shape of cut-pile; the improvement wherein a part of or the entire pile yarn on a mat surface comprise twist yarns formed by twisting two or more temporary twist yarns, each temporary twist yarn of the twist yarn is formed by twisting a paralleled yarn comprising a great number of single yarns of one-kind fiber selected voluntarily from BCF nylon, vinylon, rayon, acryl, polyester, cotton etc., and one or more nylon monofilament single yarns; and a number of kind of the paralleled yarn fiber is one or two or larger in the entire temporary twist yarn of the twist yarn.

According to the foregoing first invention, a part of or the entire pile yarn tufted onto the mat comprise the twist yarns including the nylon monofilament single yarn, and the nylon monofilament single yarn is twisted together in the temporary twist yarn and further in the twist yarn. Therefore, the mat can provide the following effects.

(1) The pile yarn can be made stiff as a whole, so that a brushing force can be improved as compared with the conventional indoor mat composed of the BCF nylon twist yarn only.

(2) Two or more nylon monofilament single yarns are twisted in the pile yarn, so that the state where two or more temporary twist yarns are twisted can be maintained and the two or more temporary twist yarns can be prevented from being separated and opened each other at the cut end faces. In addition, one or more nylon monofilament single yarns are twisted with the paralleled yarn in the temporary twist yarn, so that the temporary twist yarns themselves can be prevented from being opened at the cut end face. Therefore, when the mat is used for a dust control mat, a brushing effect of the pile yarn can be maintained effectively and a repeating service frequency through washing of mat can be improved conspicuously.

(3) Even when a repeated load is applied on the mat in its vertical direction, the pile yarn is hard to fall down. Even if the pile yarn is compressed, it exerts a remarkable recovery force to recover its original state. Therefore, a durability of the mat can be improved from this point too.

(4) As a whole of mat, the merits of the both: the conventional indoor mat comprising the BCF nylon twist yarn only and the conventional outdoor mat comprising the nylon monofilament single yarn only, can be provided and the demerits of the both can be compensated. Accordingly, this mat can be effectively used for a mat applied to an intermediate purpose for indoor and outdoor.

A second invention of this application, in addition to the structure of the foregoing first invention, is characterized by that the pile yarn is tufted not only in a straight direction but in a direction including an oblique direction, and the pile yarns are arranged on the mat surface into a rough part corresponding to the straight tufting part and a dense part corresponding to the oblique tufting part.

According to the foregoing second invention, the same effect as the mat of first invention can be provided. Further, the mat surface is composed of the dense and rough parts created by the pile yarn arrangements to form a corrugated surface, so that the brushing force can be improved as compared with a case including no corrugated surface. In addition, a cubic design effect can be provided owing to the corrugated surface.

A third invention of this application, in addition to the structure of the foregoing second invention, is characterized by that a twist yarn, which is formed by twisting two or more paralleled yarns comprising a great number of single yarns of one-kind fiber selected voluntarily from the BCF nylon, vinylon, rayon, acryl, polyester, cotton, is tufted onto the rough part of the pile yarn arrangement. In the entire temporary twist yarn of the twist yarn, the number of kind of the paralleled yarn fiber is one, or two or larger.

According to the foregoing third invention, the same effect as the foregoing mat of second invention can be provided. In addition, a holding ability of moisture and dust can be improved as compared with the foregoing mat of second invention, and a variation of color pattern can be given to the mat to meet demands of customer. Further, a variation of corrugated design can be given to the mat surface, so that a beautiful design can be created on it.

DETAILED DESCRIPTION OF THE INVENTION (Embodiment 1)

Figure 1:
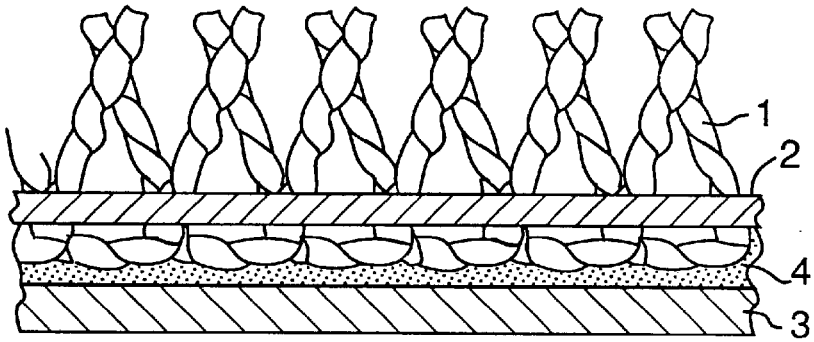
FIG. 1 is a vertically sectional partial view of a mat of embodiment 1.
Figure 2:
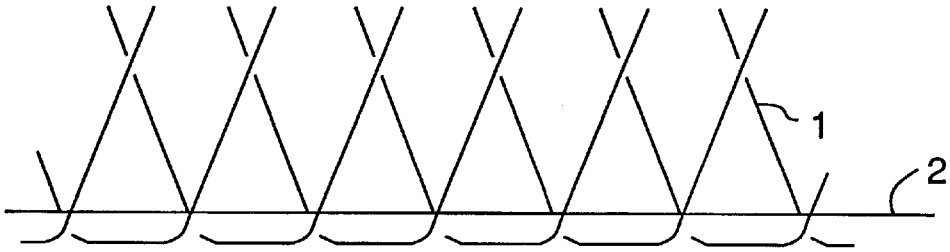
FIG. 2 is a schematic view showing a state of a pile yarn of FIG. 1.
Figure 3:
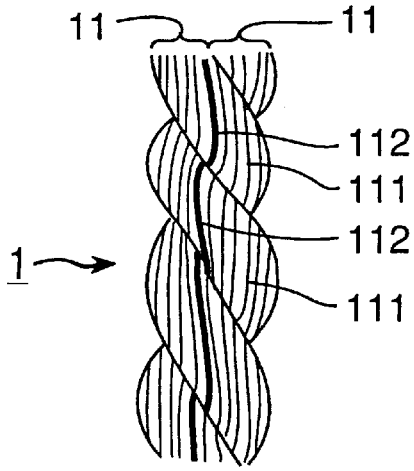
FIG. 3 is an enlarged partial view of the pile yarn of embodiment 1.

FIG. 1 is a vertically sectional partial view of a mat of this embodiment. FIG. 2 is a schematic view showing a state of a pile yarn of FIG. 1. FIG. 3 is an enlarged partial view of the pile yarn. A pile yarn 1 comprises a twist yarn formed by twisting two temporary twist yarns 11 as shown by FIG. 3. The temporary twist yarn 11 is formed by twisting a paralleled yarn 111 comprising a great number of BCF nylon single yarns and one nylon monofilament single yarn 112. In the mat of this embodiment, the entire pile yarn on the mat surface is composed of the pile yarn 1.

The mat having the foregoing structure is manufactured in the following manner.

In the first stage, one paralleled yarn 111 is formed by summarizing sixty eight BCF nylon single yarns. This one paralleled yarn 111 and one nylon monofilament single yarn 112 are subjected to a first twist respectively, and the both are subjected together to a final twist to form one temporary twist yarn 11. Another one temporary twist yarn 11 is also formed in the same manner.

In the second stage, the two temporary twist yarns 11 are subjected to the first twist respectively, the both are subjected together to the final twist and thermally set by wet heat at 120~140° C. for one to five minutes. The final twisting state is shown in FIG. 3. The pile yarn 1 comprising the twist yarn is prepared by this process.

In the next stage, the pile yarn 1 is tufted onto a base cloth 2 by a tufting machine, the entire or a part of it is subjected to a cut piling, and then the pile yarn 1 is fixed by a bonding agent such as a latex 4, as occasion demands, onto a non-piled surface of the base cloth 2. The pile yarn 1 tufted onto the base cloth 2 is secured to a rubber sheet 3. The mat of FIG. 1 is prepared by this process.

In the mat comprising the pile yarn 1 having the above-mentioned structure, the nylon monofilament single yarn 112 is twisted in the temporary twist yarn 11 and further in the pile yarn 1. Therefore, the mat provides the following functions.

(1) The pile yarn 1 becomes stiff as a whole. Consequently, its brushing force can be improved as compared with the mat comprising the BCF nylon twist yarn only. The pile yarn 1 becomes opened to V-shape as shown in FIG. 2.

(2) The two nylon monofilament single yarns 112 are apt to keep the twisted state in the pile yarn. Therefore, the state where two temporary twist yarns 11 are twisted is kept as it is too, so that the two temporary twist yarns 11 become hard to be opened at the part of cut end face. Further, in the temporary twist yarn 11, one nylon monofilament single yarn 112 is twisted with the paralleled yarn 111 so that the temporary twist yarn 11 itself becomes hard to be opened at the cut end face. For this reason, when the mat is used for a dust control mat, the pile yarn 1 can maintain a brushing effect effectively. Accordingly, a repeating service frequency through washing of mat can be improved conspicuously.

(3) Even when a repeated load is applied on the mat in its vertical direction, the pile yarn 1 is hard to fall down. Even if the pile yarn is compressed, it exerts a remarkable recovery force to recover its original state. Therefore, a durability of the mat can be improved from this point too.

(4) As a whole of mat, the merits of the both: the conventional indoor mat comprising the BCF nylon twist yarn only and the conventional outdoor mat comprising the nylon monofilament single yarn only, can be provided and the demerits of the both can be compensated. In other words, a holding ability of moisture and dust similar to that of the conventional indoor mat can be provided and its brushing force becomes excellent, and a holding ability of moisture and dust becomes excellent although its brushing force is a little inferior to that of the conventional outdoor mat. Accordingly, this mat can be effectively used for a mat having an intermediate purpose for indoor and outdoor.

In the pile yarn 1 having the above structure, two temporary twist yarns 11 are twisted to form the twist yarn, but three or more temporary twist yarns may be used. Further, one nylon monofilament single yarn 112 is used for one temporary twist yarn 11, but two or more nylon monofilament single yarns 112 may be used therefor.

(Embodiment 2)

In the mat of embodiment 1, the pile yarn 1 is used for all of the pile yarns on the mat surface, however, it may be used for a part of the pile yarn. For example, the pile yarn 1 is used within a range, equal to or larger than 40% and smaller than 100%, of a quantity of the entire pile yarn on the mat surface.

(Embodiment 3)

In the pile yarn 1 of embodiment 1, the BCF nylon is used for the paralleled yarn 111 of all of the temporary twist yarn 11 forming the twist yarn. However, one kind of fiber voluntarily selected from vinylon, rayon, acryl, polyester and cotton, may be used in place of the BCF nylon.

(Embodiment 4)

In the pile yarn 1 of embodiment 1, the fiber material of the paralleled yarn 111 is only one kind of BCF nylon for the entire temporary twist yarn 11 forming the twist yarn, however, the fiber material may comprise two kinds selected voluntarily from the BCF nylon, vinylon, rayon, acryl, polyester and cotton. For example, in the pile yarn 1 of FIG. 3, there may be a case where the vinylon is used for the paralleled yarn 111 of the one-side temporary twist yarn 11 and the cotton is used for the paralleled yarn 111 of the other-side temporary twist yarn 11.

Further, for all of the temporary twist yarns 11 when using three or more temporary twist yarns 11 forming the twist yarn, the fiber material of the paralleled yarn 111 may comprise two kinds or three or more kinds voluntarily selected from the BCF nylon, vinylon, rayon, acryl, polyester and cotton.

(Embodiment 5)

Figure 4:
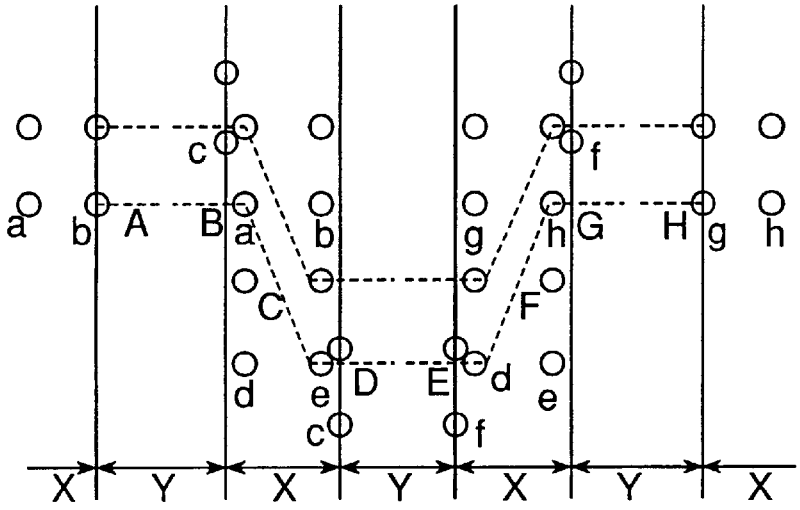
FIG. 4 is a schematic partial plan view of a mat of embodiment 5.

FIG. 4 is a schematic partial plan view of a mat of this embodiment. In the mat of this embodiment, the pile yarn 1 same as embodiment 1 is used. Differing from the embodiment 1, however, the tufting is done not only in the straight direction but also in the oblique direction.

Figure 5:
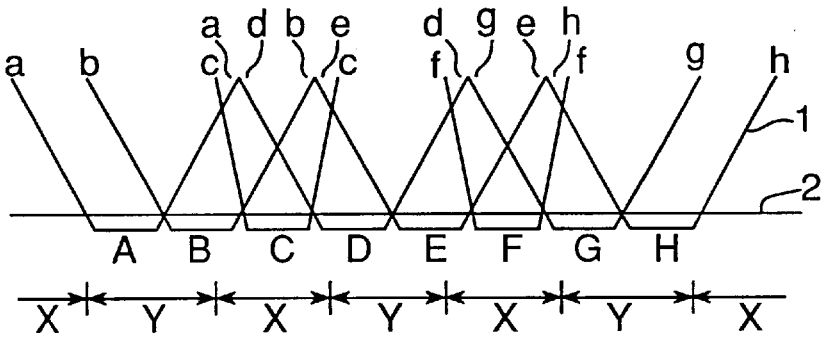
FIG. 5 is a schematic side view of a pile yarn tufted by one needle of FIG. 4.

In FIG. 4, only a part tufted by two needles is illustrated. Symbols A through H represent back sides of the tufted pile yarn, and symbols a through H represent cut end face portions of the pile yarn extending from the back sides A through H respectively. FIG. 5 is a schematic side view of the pile yarn tufted by one needle of FIG. 4. As seen from FIG. 4, the cut end faces of pile yarns are dense in X-part where the oblique tufting is done as compared with Y-part where the straight tufting is done. Namely, in the mat of this embodiment, the dense X-part corresponding to the oblique tufting part and the rough Y-part corresponding to the straight tufting part are created in the arrangement of the pile yarn on the mat surface. Other structures are same with those of embodiment 1.

In the mat having the above structure, the mat surface is composed of the X-part where the pile yarn is arranged densely and the Y-part where the pile yarn is arranged roughly. Therefore, the X-part creates a convex portion and the Y-part creates a concave portion, so that the mat surface is corrugated. For this reason, the brushing force can be improved as compared with the mat of embodiment 1 including no corrugation. Further, the cubic beautiful design is provided owing to the corrugation.

In addition, the pile yarn 1 same as the embodiment 1 is used in the mat having the above structure, so that the foregoing effects (1) to (4) can be provided in the same manner as the embodiment 1.

(Embodiment 6)

In the embodiment 5, the structures of embodiments 2 through 4 may be used.

(Embodiment 7)

Figure 6:
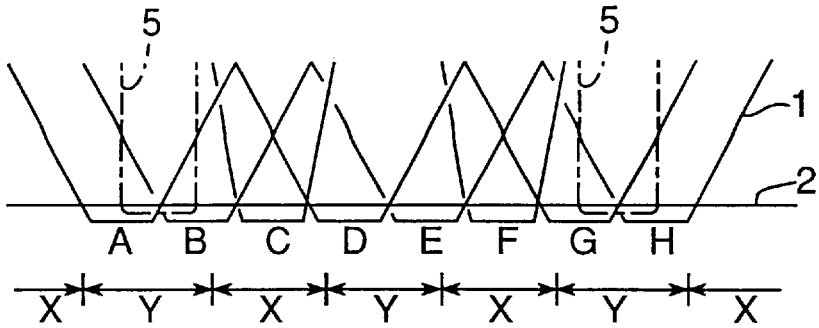
FIG. 6 is a view corresponding to FIG. 5 of a mat of embodiment 7.
Figure 7:
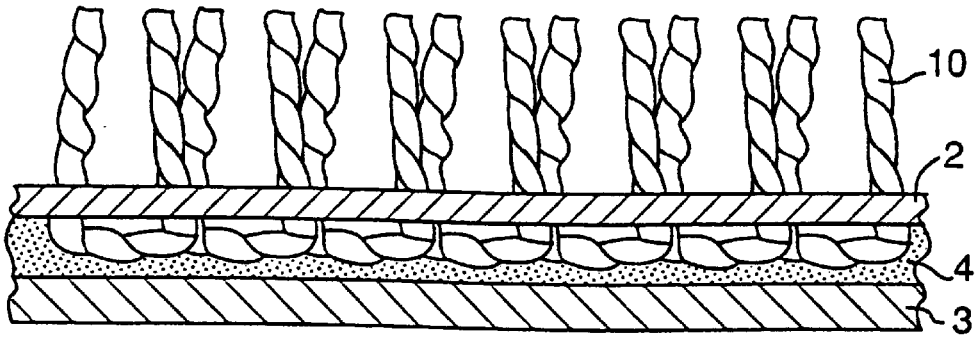
Fig.7 PRIOR ART
FIG. 7 is a vertical sectional partial view of a conventional indoor mat.
Figure 8:
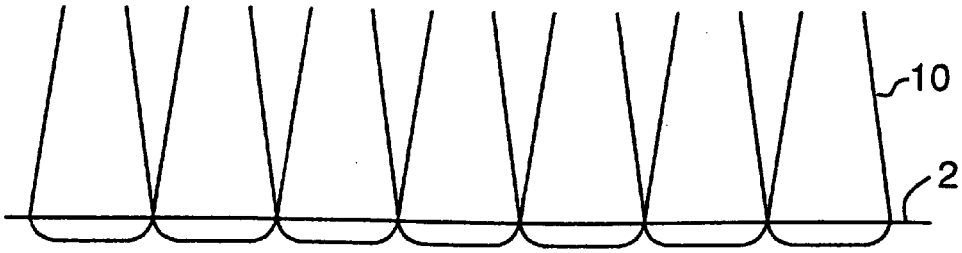
Fig.8 PRIOR ART
FIG. 8 is a schematic view showing a state of the pile yarn of FIG. 7.
Figure 9:
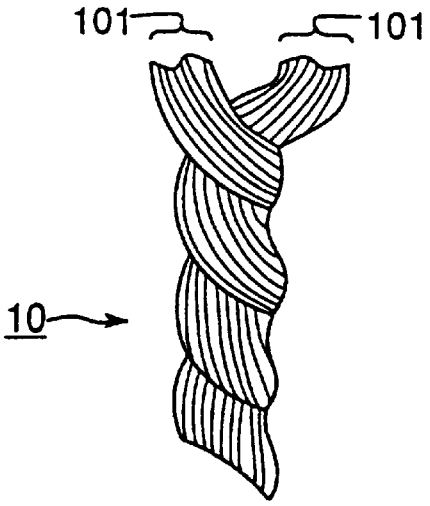
Fig.9 PRIOR ART
FIG. 9 is an enlarged partial view showing a state of a pile yarn of the conventional indoor mat.

FIG. 6 is a view corresponding to FIG. 5 of the mat of this embodiment. The mat of this embodiment is so constructed that, in the mat of embodiment 5, a pile yarn 5 is tufted on the entire or a part of the rough Y-part in the pile yarn arrangement, as illustrated by FIG. 6. The pile yarn 5 is composed of the BCF nylon twist yarn formed by twisting two paralleled yarns comprising a great number of the BCF nylon single yarns.

In concrete, the pile yarn 5 is made up in the following manner. In the first stage, sixty eight BCF nylon single yarns are summarized to form one paralleled yarn. Another one paralleled yarn is made up in the same way. In the next stage, the two paralleled yarns are subjected to the first twist respectively, and the both are subjected together to the final twist and thermally set by wet heat at 120~140° C. for one to five minutes. Thereby, the pile yarn 5 comprising the BCF nylon twist yarn is prepared by this process.

In the mat having the above structure, a function owing only to the pile yarn 5 is added to the function of the mat of embodiment 5. In other words, as compared with the mat of embodiment 5, the holding ability of moisture and dust can be improved and the variation of color satisfying demands of customer can be given to the mat. Further, since a part of concave portion of the mat surface corrugation is filled with the pile yarn 5, it becomes possible to give variation to the design of corrugation so that the beautiful design can be provided.

In the pile yarn 5 having the above structure, the two paralleled yarns are twisted to form the twist yarn. However, three or more paralleled yarns may be used.

(Embodiment 8)

In the pile yarn 5 of embodiment 7, the BCF nylon is used for all of the paralleled yarns forming the twist yarn. However, one kind of fiber voluntarily selected from vinylon, rayon, acryl, polyester and cotton, may be used in place of the BCF nylon.

(Embodiment 9)

In the pile yarn 5 of embodiment 7, the fiber material of the entire paralleled yarn forming the twist yarn comprises one kind of BCF nylon only, however, it may be two kinds selected from the BCF nylon, vinylon, rayon, acryl, polyester and cotton.

Further, when three or more paralleled yarns forming the twist yarn are used, the fiber material of the entire paralleled yarn may comprise two kinds or three or more kinds voluntarily selected from the BCF nylon, vinylon, rayon, acryl, polyester and cotton.

EXAMPLE 1

- Pile yarn . . .
  - BCF nylon . . . Total denier: 1,300 deniers (Single yarn denier: 19 deniers)
  - Nylon monofilament . . . Single yarn denier: 325 deniers
  - Number of twist . . . First twist: 180 times/m, S-twist
    - Final twist: 180 times/m, Z-twist Sixty eight BCF nylon single yarns were summarized to form a paralleled yarn of 1,300 deniers. This one paralleled yarn and one nylon monofilament single yarn were subjected to the first twist respectively, and the both were subjected together to the final twist to form one temporary twist yarn. Another one temporary twist yarn was made up in the same way. The two temporary twist yarns were subjected to the first twist respectively, and the both were subjected together to the final twist and thermally set by wet heat at 125° C. for two minutes. A pile yarn to be tufted was prepared by this process.

Other conditions . . .

Stitch: 6 pcs./inch

Gauge: 32 pcs./5 inches

Pile length: 9 mm

Pile density: 990 g/m$^2$

Pile shape: Cut-pile

Base cloth . . . Polyester non-woven fabric: 150 g/m$^2$

COMPARISON EXAMPLE 1

●Pile yarn . . .
●BCF nylon . . . ●Total denier: 1,300 deniers (Single yarn denier: 19 deniers)
●Number of twist . . . ●First twist: 180 times/m, S-twist ●Final twist: 180 times/m, Z-twist Sixty eight BCF nylon single yarns were summarized to form a paralleled yarn of 1,300 deniers. Another one paralleled yarn was made up in the same way. Then, the two paralleled yarns were subjected to the first twist respectively, and the both were subjected together to the final twist and thermally set by wet heat at 125° C. for two minutes. A pile yarn to be tufted was prepared by this process.

Other conditions . . .

Stitch: 6 pcs./inch

Gauge: 32 pcs./5 inches

Pile length: 9 mm

Pile density: 880 g/m$^2$

Pile shape: Cut-pile

Base cloth . . . Polyester non-woven fabric: 150 g/m$^2$

EXAMPLE 2

●Pile yarn . . .
●Polyester filament . . . ●Total denier: 1,300 deniers (Single yarn denier: 2 deniers)
●Nylon monofilament . . . ●Single yarn denier: 325 deniers
●Number of twist . . . ●First twist: 180 times/m, S-twist ●Final twist: 180 times/m, Z-twist Six hundreds and fifty polyester filament single yarns were summarized to form a paralleled yarn of 1,300 deniers. This one paralleled yarn and one nylon monofilament single yarn were subjected to the first twist respectively, and the both were subjected together to the final twist to form one temporary twist yarn. Another one temporary twist yarn was made up in the same way. The two temporary twist yarns were subjected to the first twist respectively, and the both were subjected together to the final twist and thermally set by wet heat at 140° C. for three minutes. A pile yarn to be tufted was prepared by this process.

Other conditions . . .

Stitch: 6 pcs./inch

Gauge: 32 pcs./5 inches

Pile length: 9 mm

Pile density: 1,250 g/m$^2$

Pile shape: Cut-pile

Base cloth . . . Polyester non-woven fabric: 120 g/m$^2$

COMPARISON EXAMPLE 2

●Pile yarn . . .
●Polyester filament . . . ●Total denier: 1,300 deniers (Single yarn denier: 2 deniers)

-continued

●Number of twist . . . ●First twist: 180 times/m, S-twist ●Final twist: 180 times/m, Z-twist Six hundreds and fifty polyester filament single yarns were summarized to form a paralleled yarn of 1,300 deniers. Another one paralleled yarn was made up in the same way. Then, the two paralleled yarns were subjected to the first twist respectively, and the both were subjected together to the final twist and thermally set by wet heat at 140° C. for two minutes. A pile yarn to be tufted was prepared by this process.

Other conditions . . .

Stitch: 6 pcs./inch

Gauge: 32 pcs./5 inches

Pile length: 9 mm

Pile density: 1,000 g/m$^2$

Pile shape: Cut-pile

Base cloth . . . Polyester non-woven fabric: 120 g/m$^2$ (Test)

The mat original clothes made up according to the foregoing examples 1 & 2 and comparison examples 1 & 2 were cut to 70 cm-wide and 85 cm-long sheet, and placed on 2 mm thick unvulcanized NBR rubber sheets. They were pressed for 15 minutes at 170° C. with a pressure of 8 kg/cm$^2$ to be subjected to a bonding vulcanizing press, so that integral mats were made up.

These mats were place on a road passed by about 3,000 persons per day for three days, and subjected to ordinary washing retreatments for rental mat. Measurements of dust adhering to shoe soles of passersby were done on mats subjected to the washing retreatment once and twenty times respectively, and dust carry-in rates were calculated. Results are listed in Table 1. The dust carry-in rate is a value calculated by dividing a dust quantity remaining on shoe sole by a dust quantity adhering to the mat, after the mat is trodden. Here, the rates were calculated from mean value of 100 passersby.

TABLE 1

| | One-time washing retreatment | 20-times washing retreatment |
|---|---|---|
| Example 1 | 5.3% | 3.8% |
| Example 2 | 4.6% | 3.2% |
| Comparison example 1 | 25.5% | 24.8% |
| Comparison example 2 | 18.4% | 20.3% |

As obvious from Table 1, according to the examples 1 & 2, i.e. the mats of this invention, the corrugated surfaces of shoe soles could be brushed efficiently. Further, the mat could be used without impairing its ability even after being subjected to the washing retreatment repeatedly.

We claim:

1. A mat, in which a pile yarn is tufted onto a base cloth and the entire or a part of pile shape is a cut pile, the improvement wherein a part of or the entire pile yarn on a mat surface comprises a twist yarn formed by twisting two or more temporary twist yarns together, each temporary twist yarn of the twist yarn is formed by twisting a paralleled yarn comprising a great number of single yarns of one-kind fiber selected voluntarily from BCF nylon, vinylon, rayon, acryl, polyester and cotton; and one or more nylon monofilament single yarns, and a number of kind of paralleled yarn fiber is one or two or larger in the entire temporary twist yarn of the twist yarn.

2. A mat as set forth in claim 1, in which the pile yarn is tufted not only in a straight direction but in an oblique direction, and a rough part corresponding to the straight tufting and a dense part corresponding to the oblique tufting are created in pile yarn arrangement on a mat surface.

3. A mat as set forth in claim 2, in which a twist yarn formed by twisting two or more paralleled yarns comprising a great number of single yarns of one-kind fiber selected voluntarily from BCF nylon, vinylon, rayon, acryl, polyester and cotton; is tufted on the rough part in the pile yarn arrangement, and a number of kind of paralleled yarn fiber is one or two or larger in the entire temporary twist yarn of the twist yarn.

* * * * *